US007637381B2

(12) United States Patent
Foxx et al.

(10) Patent No.: US 7,637,381 B2
(45) Date of Patent: Dec. 29, 2009

(54) SWIVEL FITTING

(75) Inventors: Michael Foxx, Hillsborough, NJ (US); Lin Hua, Jersey City, NJ (US)

(73) Assignee: Strato, Inc., Piscataway, NJ (US)

( * ) Notice: Subject to any disclaimer, the term of this patent is extended or adjusted under 35 U.S.C. 154(b) by 419 days.

(21) Appl. No.: 11/733,458

(22) Filed: Apr. 10, 2007

(65) Prior Publication Data

US 2008/0223806 A1 Sep. 18, 2008

Related U.S. Application Data

(60) Provisional application No. 60/894,774, filed on Mar. 14, 2007.

(51) Int. Cl.
*F16L 3/00* (2006.01)

(52) U.S. Cl. ..... 213/76; 248/53

(58) Field of Classification Search ..... 213/76, 213/75 GT; 285/23, 24, 25; 248/70, 65, 248/58, 53, 67

See application file for complete search history.

(56) References Cited

U.S. PATENT DOCUMENTS 1,381,337 A * 6/1921 Rippe ..... 74/383
2,955,790 A * 10/1960 Sylvester ..... 248/65
2,996,315 A 8/1961 Roth et al.
3,027,715 A * 4/1962 Morris ..... 60/796
3,344,935 A * 10/1967 Stewart et al. ..... 213/1 R
3,567,041 A 3/1971 Seay
3,587,868 A 6/1971 Yates
4,069,836 A 1/1978 Sowinski
4,099,702 A 7/1978 Temple
4,133,561 A 1/1979 Cannon et al.
4,215,881 A 8/1980 Scott et al.
4,392,575 A 7/1983 Baker et al.
4,986,500 A 1/1991 Campbell
5,941,497 A * 8/1999 Inoue et al. ..... 248/514
7,267,306 B2 * 9/2007 Eason et al. ..... 248/53
2004/0155005 A1 8/2004 Murphy
2006/0163442 A1 7/2006 Eason

OTHER PUBLICATIONS

AAR Manual of Standards and Recommended Practices, Standard S-4021, Apr. 10, 2006.

* cited by examiner

*Primary Examiner*—Mark T Le
(74) *Attorney, Agent, or Firm*—Fitzpatrick, Cella, Harper & Scinto

(57) ABSTRACT

A brake hose support comprises: a bracket fixedly attached to the yoke of the coupling apparatus of a rail car and a swivel fitting attached to the bracket which is rotatable around a pivot center. The swivel fitting can be rotated so that the angle of the end hose opening with respect to the angle cock is adjustable.

7 Claims, 2 Drawing Sheets

SWIVEL FITTING

This application claims the benefit of U.S. Provisional Application No. 60/894,774, filed Mar. 14, 2007, which is incorporated by reference.

BACKGROUND OF THE INVENTION

1. Field of the Invention

The present invention is directed to an apparatus for supporting brake hoses between rail cars. Specifically, a swivel fitting according to the invention accommodates the connection of an end hose to an intermediate hose at different angles, thereby reducing kinks and unintentional hose uncoupling.

2. Description of Related Art

The American Association of Railroads ("AAR") Standard S-4021 (Adopted 1999 and last revised 2006), incorporated herein by reference, depicts an arrangement for attaching a brake hose assembly between rail cars. As shown in the Figures published with the S-4021 Standard, a fixed brake line attached to the rail car terminates at an angle cock valve. The angle cock valve is attached (usually via an adapter) to an intermediate hose. The intermediate hose is connected to an end hose by a fitting, sometimes referred to as the train line support casting, which is supported on a bracket attached to the yoke of the coupling apparatus between adjacent rail cars. AAR specifications require that the distance between the fitting connecting the intermediate hose to the end hose and the coupler pulling face, where the force is applied between the two adjacent rail cars, is in a range of 21½ to 22½ inches.

This is self-evidently a relatively narrow tolerance. If the distance is too long, the hose may detach, or the connection with the end hose of an adjacent rail car becomes difficult to make. If the distance is too short, the hose may kink. The S-4021 standard calls for the fitting where the end hose meets the intermediate hose to be angled 20 degrees with respect to the angle cock valve, which alleviates the problem by allowing use of a longer hose. However, the concomitant problem is that the standard hose length may then be too short.

Attempts to address this problem include the trolley arrangement, and a so-called hybrid arrangement, in which the train line support casting (i.e., the fitting where the end hose is connected to the intermediate hose) is movable in the axial direction of the rail car along a rod attached to the support bracket, as disclosed in U.S. patent application Ser. No. 11/038,250 now U.S. Pat. No. 7,267,306, incorporated herein by reference in its entirety. However, it is believed that a fitting permitting this axial motion is inherently unreliable and results in more unwanted brake hose uncoupling.

Therefore it would be desirable if there were a brake hose support that, on one hand, utilized a fixed bracket to minimize movement of the end hose connection to the intermediate hose, but at the same time allowed for some differences in distance between the end hose connection of adjacent rail cars and the coupling with respective intermediate hoses.

SUMMARY OF THE INVENTION

Thus, a brake hose support according to the invention comprises: a bracket fixedly attached to the yoke of the coupling apparatus of the rail car, and a swivel fitting attached to the bracket which is rotatable around a pivot center. The swivel fitting has openings at opposite sides to receive the intermediate hose and the end hose of the brake hose assembly, and the swivel fitting can be rotated so that the angle of the end hose opening with respect to the angle cock is adjustable.

DETAILED DESCRIPTION OF THE PREFERRED EMBODIMENTS

Directions herein are given with respect to the normal orientation of a rail car. Thus the "longitudinal axis" and the "axial direction," unless otherwise stated, means parallel to the longitudinal axis of the train. This axis should be considered as running through the middle of the coupler between adjacent rail cars.

Figure 1:
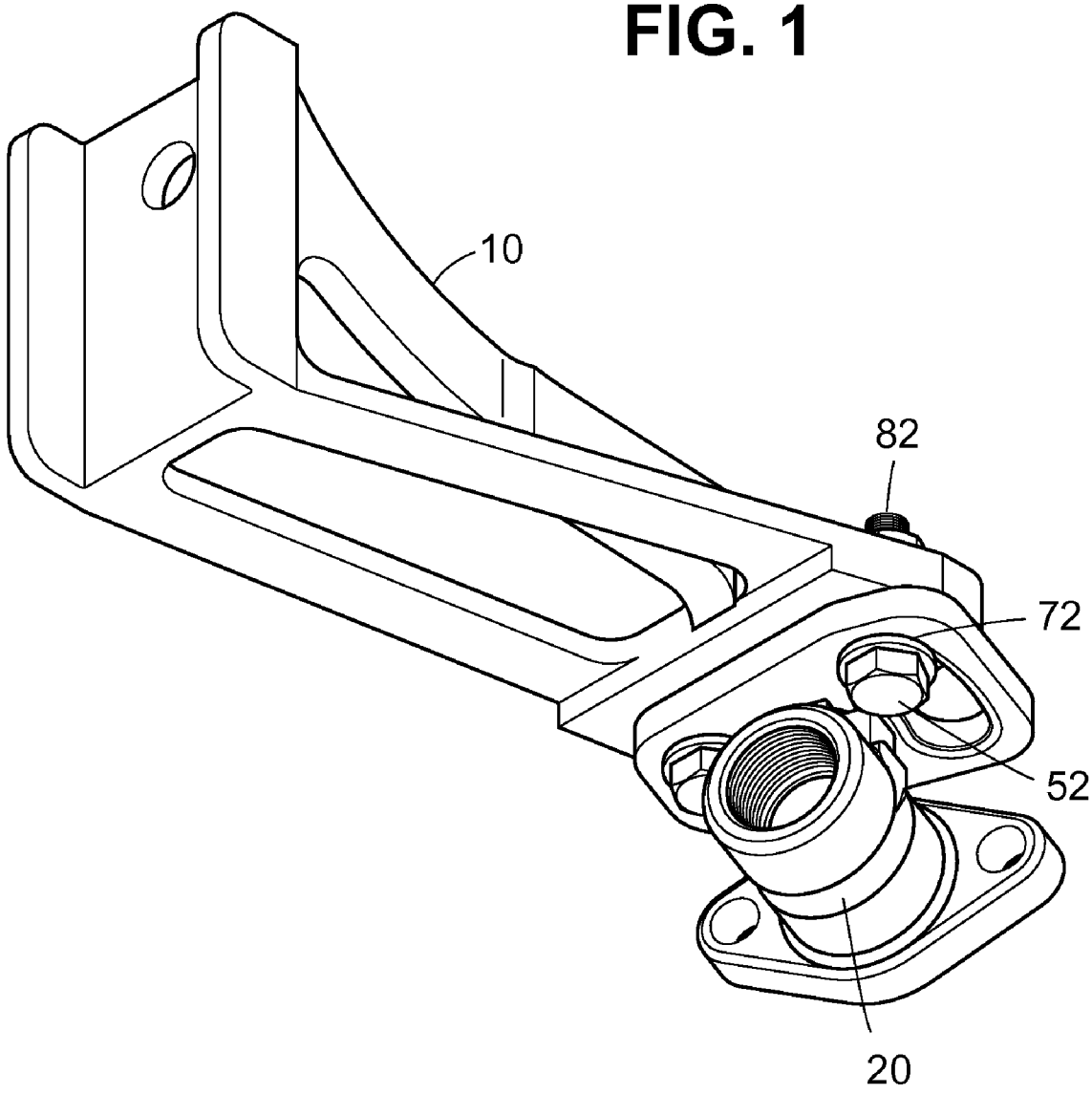
FIG. 1 is a perspective view of a brake hose support according to an embodiment of the invention.

The present invention has application to cushion cars, in which the coupling apparatus includes a coupler pinned to a yoke which houses a draft gear. The best known yokes for cushion cars are the E-type yoke and the F-type yoke. Fixed brackets are commonly referred to as an E-type bracket and F-type bracket based on what type of yoke is being used. The E-type bracket is shown in FIG. 1, and would be readily recognizable to one of ordinary skill in the art. The F-type bracket, a similarly right-angled element, has sides having similar length, and one of ordinary skill in the art would be able to identify the same.

The arrangement of a fixed brake line and angle cock, coupler and yoke elements is known to those of ordinary skill. Reference may be made to U.S. Pat. Nos. 3,344,935, 3,567,041, 3,587,868, 4,215,881, 4,392,575, and 4,986,500, which describe the state of the art and which are incorporated by reference in their entirety. As these elements serve merely as points of reference in the description of the invention herein, they are not illustrated or described in detail.

As seen in FIG. 1 a brake hose support according to the invention includes a bracket 10, fixedly attached to the yoke of the coupling apparatus. An E-type bracket is shown in the Figure, but the invention could also utilize an F-type bracket, or other type of bracket that may hereafter come into favor for a fixed bracket brake hose support.

The swivel fitting 20 is attached to the bracket and is rotatable around a pivot center 30. Conventionally, an end hose is threaded, and therefore the swivel fitting has a threaded opening 40 for receiving the end hose. The intermediate hose generally has a flange, and therefore the swivel fitting is also provided with a flange 44.

Figure 2:
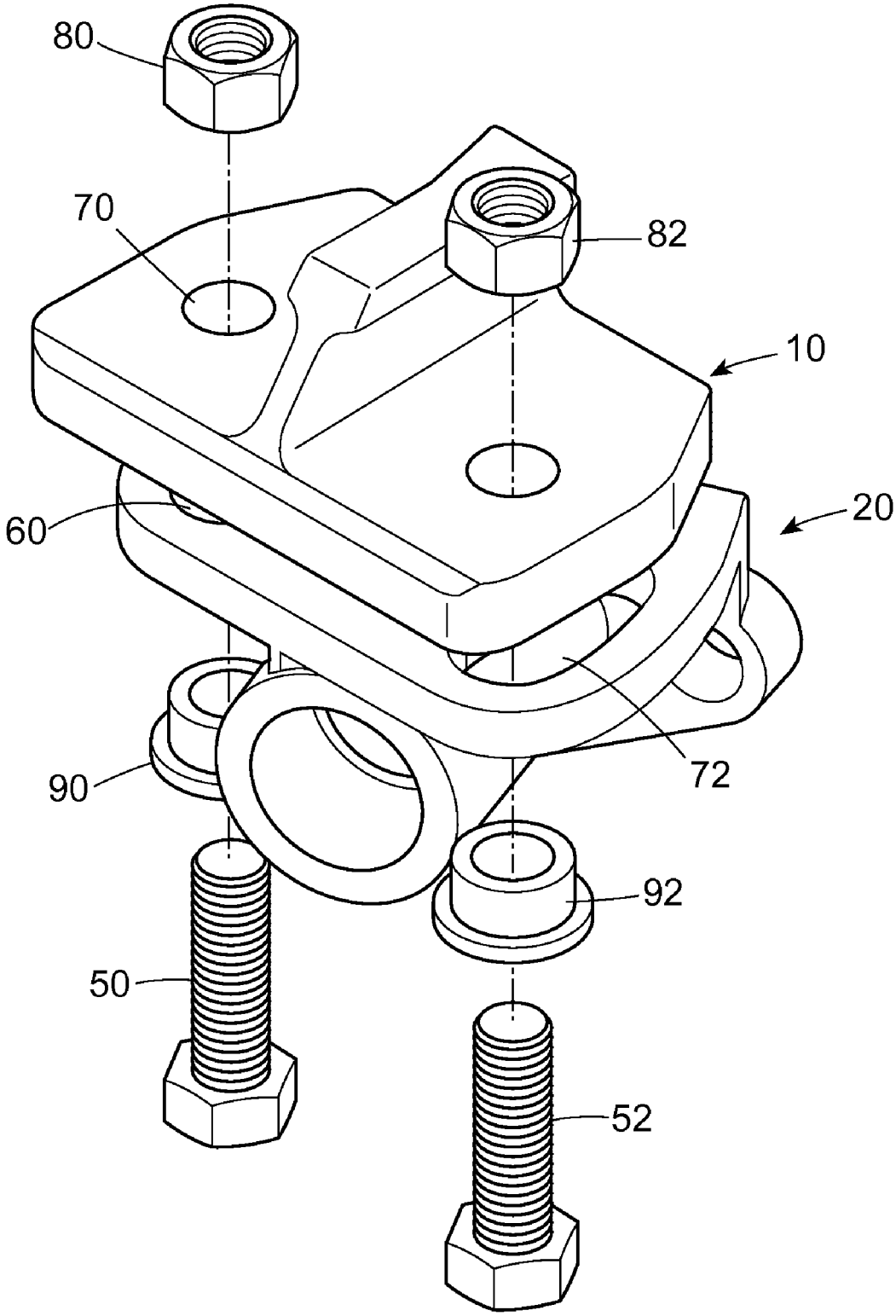
FIG. 2 is an exploded view of the swivel fitting according to an embodiment of the invention.

A preferred mechanism whereby the opening for receiving the end hose can be adjusted relative to the angle cock (not shown) is shown in FIG. 2, including a first bolt 50 passing through a hole 60 at the pivot center and through a corresponding hole 70 in the bracket 10. This is secured by tack welding a nut 80 on the bolt 50. A first spacer 90 between the sides of the hole and the bolt permits rotation of the swivel fitting around the pivot center. Although separate bolts are shown in the preferred embodiment depicted in the Figures, similarly shaped protrusions might be provided on the bracket or the fitting and such arrangement would be within the scope of the invention.

A second elongated through hole 72 has a curved shape, and second bolt 52 passes through the second through hole in the swivel fitting and is attached the bracket with a nut 82 that is likewise tack welded to the bolt 52 such that the swivel fitting is movably attached to the bracket. A second spacer 92 between the sides of the second through hole and the second bolt permits rotational movement of the swivel fitting. Opposite ends of the curved shape of the second elongated through hole define the extent of rotation of the swivel fitting, so that movement of the swivel fitting stops when the second bolt meets a respective end of the curved second through hole. Other mechanisms for permitting rotation of the swivel fitting may be adapted according to the ordinary skill in the art, for example a curved elongated through hole might be provided on the bracket. Likewise, a raised stop on the fitting or bracket could alternatively be used to limit rotational movement. Such variations would be within the scope of the invention claimed herein.

It is preferred that the extent of rotational movement is such that the angle between a line perpendicular to the end hose opening (herein, simply the "end hose opening") and a longitudinal axis of the rail car ranges from about twenty degrees toward the angle cock to about 10 degrees on the opposite side of the longitudinal axis of the rail car.

The foregoing description of the preferred embodiments is for the purposes of illustration only and is not to be considered as limiting the invention defined by the appended claims.

What is claimed is:

1. In a rail car having a coupler, a yoke and a brake hose assembly, a brake hose support comprising:

a bracket fixedly attached to the yoke of the rail car;

a swivel fitting attached to the bracket and rotatable around a pivot center;

the swivel fitting having openings at opposite sides thereof to receive an intermediate hose at one side and an end hose at the opposite side;

a first through hole at the pivot center;

a first bolt passing through the first through hole attaching the swivel fitting to the bracket;

a first spacer between the sides of the first through hole and the first bolt, permitting rotation of the swivel fitting around the pivot center;

a second elongated through hole having a curved shape;

a second bolt passing through the second through hole; and a second spacer between the sides of the second through hole and the second bolt; wherein opposite ends of the curved shape of the second elongated through hole define the extent of rotation of the swivel fitting around the pivot center, so that movement of the swivel fitting stops when the second bolt meets a respective end of the curved second through hole, whereby the opening in the swivel fitting receiving the end hose can be adjusted to different angles with respect to an angle cock attached to the brake hose assembly.

2. The brake hose support of claim 1, wherein nuts attaching the first and second bolts to secure the swivel fitting to the bracket are tack welded.

3. The brake hose support of claim 1, wherein the different angles of the opening receiving the end hose with respect to the angle cock valve range from −10 degrees to +20 degrees, measured from a longitudinal axis of the rail car, with positive being in the direction of the angle cock.

4. The brake hose support of claim 1, wherein the bracket is an F bracket.

5. The brake hose support of claim 1, wherein the bracket is an E bracket.

6. The brake hose support of claim 1, wherein the swivel fitting has a flange for connecting to the intermediate hose and a threaded connection for receiving the end hose.

7. The brake hose support of claim 1, wherein the swivel fitting is bolted and tack welded to the bracket.

* * * * *